US005149260A

United States Patent [19]

Foust

[11] Patent Number: 5,149,260

[45] Date of Patent: Sep. 22, 1992

[54] DEVICE AND METHOD FOR COMBUSTION OF WASTE OIL

[76] Inventor: Harry D. Foust, Rte. 1, Box 92U, Bridgewater, Va. 22812

[21] Appl. No.: 695,438

[22] Filed: May 3, 1991

Related U.S. Application Data

[63] Continuation of Ser. No. 345,953, May 1, 1989, abandoned.

[51] Int. Cl.[5] ..... F23D 11/44

[52] U.S. Cl. ..... 431/11; 431/12; 431/28; 431/32; 431/36; 431/37; 431/208; 431/211

[58] Field of Search ..... 431/3, 8, 11, 12, 14, 431/28, 32, 5, 121, 117, 207, 208, 211, 160, 243, 245, 258, 36, 37, 246

[56] References Cited

U.S. PATENT DOCUMENTS

| | | | |
|---|---|---|---|
| 692,839 | 2/1902 | Farraday et al. | 431/243 |
| 1,648,069 | 11/1927 | Shore | 431/243 |
| 2,363,098 | 11/1944 | Tullis | 431/207 X |
| 2,876,830 | 3/1959 | Duy | 431/36 |
| 3,552,331 | 1/1971 | Widdig . | |
| 3,698,362 | 10/1972 | Ishibashi et al. . | |
| 3,718,424 | 2/1973 | Konagai . | |
| 3,804,333 | 4/1974 | Kramer et al. . | |
| 3,914,094 | 10/1975 | Landry . | |
| 4,008,038 | 2/1977 | Berthiaume | 431/11 |
| 4,149,842 | 4/1979 | Benjamin . | |
| 4,155,702 | 5/1979 | Miller et al. . | |
| 4,162,887 | 7/1979 | Gray . | |
| 4,164,390 | 8/1979 | Bouvin | 431/208 X |
| 4,249,885 | 2/1981 | Reich . | |
| 4,392,820 | 1/1983 | Niederholtmeyer . | |
| 4,416,609 | 11/1983 | Weber . | |
| 4,460,328 | 7/1984 | Niederholtmeyer . | |
| 4,480,172 | 10/1984 | Ciciliot et al. | 431/208 X |
| 4,487,571 | 12/1984 | Robertson . | |
| 4,655,706 | 4/1987 | Bayh, III . | |
| 4,797,089 | 1/1989 | Schubach et al. | 431/37 X |

FOREIGN PATENT DOCUMENTS

| | | | |
|---|---|---|---|
| 576601 | 5/1959 | Canada | 431/208 |
| 0042891 | 1/1982 | European Pat. Off. . | |
| 806128 | 6/1951 | Fed. Rep. of Germany | 431/123 |
| 2153817 | 5/1973 | Fed. Rep. of Germany . | |
| 1934741 | 11/1982 | Fed. Rep. of Germany . | |
| 3230674 | 7/1983 | Fed. Rep. of Germany | 431/11 |
| 2302482 | 2/1975 | France . | |
| 234586 | 4/1986 | German Democratic Rep. . | |
| 900046 | 6/1984 | Netherlands . | |
| 8602009 | 3/1988 | Netherlands | 431/11 |
| 8600045 | 12/1986 | PCT Int'l Appl. . | |
| 445724 | 4/1936 | United Kingdom | 431/208 |
| 2091870 | 8/1982 | United Kingdom | 431/208 |

*Primary Examiner*—Carl D. Price
*Attorney, Agent, or Firm*—Sten Erik Hakanson

[57] ABSTRACT

The present invention concerns a device sequence for burning waste oil and includes a circulating system having a pump for circulating the oil therein and a heater for heating the oil to a suitable combustion temperature during this circulation. A combustion oil system is included for diverting a portion of the circulating oil to an atomizing gun for combination therein with a source of atomizing air. The gun includes a heat exchange body portion in fluid communication with the circulating system. A linear actuator is included having a rod with a needle end that is operated by the actuator in a linear manner along the central axis of the atomizing gun for extending through the injection orifice for providing mechanical cleaning thereof and for regulating oil flow therethrough. The present invention includes a control system for regulating the operation thereof. In particular, oil is heated and circulated prior to diversion to the combustion system which also allows for pre-heating of the atomizing gun. The control system also provides for a cooling cycle after combustion is stopped wherein the oil heater and oil is circulated through the gun during the removal of residual heat from the combustion chamber that exists after heating cycle shut-down.

37 Claims, 5 Drawing Sheets

DEVICE AND METHOD FOR COMBUSTION OF WASTE OIL

The present application is a co-pending continuation of application Ser. No. 07/345,953, now abandoned filed May 1, 1989.

BACKGROUND OF THE INVENTION

1. Field of the Invention

The present invention relates generally to heating devices that utilize waste oil as fuel, and more particularly to such heating devices that use waste oil as a sole fuel source, that pre-heat the waste oil prior to burning and that mix the oil with pressurized air prior to combustion thereof.

2. Background

Combustion of waste oil, and in particular drain oil as is generated by automotive and other internal combustion engines, is considered a highly desirable means of disposal of such used lubricants. Efficient combustion promises the generation of heat energy for space heating and the safe elimination of a substance considered hazardous by the United States Environmental Protection Agency. Thus, various heaters or furnaces having the ability to burn waste oil have been proposed. However, the successful combustion of waste oil, such as drain oil, presents formidable hurdles. In particular, waste lubricants contains a wide variety of contaminants, such as, unburned fuel, water, acids, and particulate matter, such as, road dirt and dust, and metal particles resulting from engine wear. These impurities can result in the clogging of standard oil furnace burning nozzles and in the production of non-flammable gasses, both of which occurrences can stop combustion. In addition, waste automotive oil is of a high viscosity as compared with standard fuel oil, thus, it is more difficult to inject into a combustion chamber from a nozzle as a fine well aerated spray.

Initial attempts at burning waste oil involved increasing the pumping force applied to the oil to compensate for its increased viscosity, however, the force needed was very high, and the small nozzle apertures would ultimately become clogged. Other efforts involving simply increasing the nozzle aperture would result in reduced clogging, but would also greatly reduce combustion efficiency as the oil would not be atomized sufficiently. Current art waste oil burners, as seen generally in U.S. Pat. Nos. 4,162,887 to Grey, 4,249,885 to Reich and 4,487,571 to Robertson et. al., include the use of electrical heaters in the oil storage tank or fuel lines thereof to reduce oil viscosity, and filters to remove particulate matter. Also, this prior art shows the use of nozzles, such as made by Delavan, Inc, wherein compressed air is introduced within the nozzle and which mixes with the oil in a circumferential or swirling motion just prior to injection of the oil into the combustion chamber. This compressed air serves to better aerate and atomize the oil as well as resist blockage of the nozzle aperture. The prior art also describes the use of a second source of compressed air exterior of the nozzle to provide for combustion of the oil, as the atomizing oil is not sufficient for this purpose. In addition, as seen in French patent No. 75 05928 to Poirier, heated waste oil can be circulated through the gun prior to combustion so that the oil and gun first reach optimal temperature to insure proper fluidity of the oil.

However, current art waste oil burners continue to be plagued by the problem of flame outage. Such outage, and thus, burner unit shut down, is primarily the result of nozzle orifice blockage by particulate matter or agglomeration of the oil, or as the result of essentially inflammable gasses being periodically ejected from the nozzle in place of the oil. Thus, the reliability of such systems is quite low as they require frequent cleaning and repair. Therefore, such systems can not be left unattended without a back-up heating system.

Accordingly, it would be highly desirable to have a heating system capable of burning waste oil in a manner that is efficient and reliable.

SUMMARY OF THE INVENTION

The objects of the present invention include, but are not limited to, the following:

1. To provide for the burning of waste oil in a manner that is energy efficient.
2. To provide for such burning in a manner that is reliable, and in particular is resistant to interruption or shut-down due to particulate formation and the production of gas.
3. To provide for the mechanical removal of any particulate or other blockage of the oil injection orifice.
4. To provide for the safe burning of waste oil.

The method and apparatus of the present invention concerns a waste oil burning device, a control system therefor, and a modified oil atomizing nozzle. The present invention can be broadly viewed as including an oil circulating system, an oil injecting system and a control system.

The oil circulating system includes a tubular network in connection with a reservoir or waste oil source, and that includes a pump, heating means for reducing the viscosity of the oil, and a filter located downstream of the heater with respect to the direction of flow of the oil. The circulatory system also includes a re-circulating oil supply, return lines, a combustion oil supply line, and a variety of sensing and valve means.

The injecting or atomizing system includes an atomizing gun for injecting the oil into a suitable combustion chamber. The gun includes an atomizing nozzle secured to one end of an elongate gun body portion, and a linear actuating means secured to the opposite end of the gun body. The atomizing nozzle includes an oil injection orifice and means for delivering compressed atomizing air in a circumferential manner about the oil orifice. Supply and return orifices on the gun body are connected to the supply and return lines respectively of the circulatory system and provide for circulating of the oil within a circulatory pathway of the body portion. A small diameter atomizing air passage extends through the gun body and provides for the delivery of air to the nozzle. A second small diameter combustion oil delivery passage extends centrally of the gun body portion and along the axis thereof, for providing fluid communication of the combustion oil to the nozzle. A cleaning pin extends down the center of the second passage and through the center of the nozzle terminating with a tip end adjacent the oil orifice. The opposite end of the pin extends through the combustion oil passage and is connected to the linear actuating means.

The atomizing system also includes a motor for operating a blower for supplying combustion air adjacent the exterior of the combustion oil orifice. The motor is also connected to the pump of the oil circulating and injecting systems to provide for flow of oil there through. The atomizing system further includes a variety of control and sensing means for regulating the oil flow and ignition.

The control system includes a plurality of relays, electronic control devices, and the like, and the necessary circuitry for connecting such devices with the control and sensing means of the delivery and atomizing systems. The operation of the present invention, as regulated by the control system, can be viewed as including four separate steps; off, pre-heat, burn, and post-burn cool down. Thus, the system is initially off until a thermostat in the space to be heated signals for the delivery of heat. The motor is then started thereby operating the pump and the blower. In particular, the oil first flows past the heater then through the filter after which it travels through the supply line and into the circulating pathway of the body portion of the atomizing gun. The oil then flows along the length of the tubular body of the atomizing gun and returns to the circulatory system via the return line to repeat the above described pathway. This closed loop circulation continues until the circulating oil and atomizing gun and nozzle, by conduction from the heated oil, reach the desired temperature range of 140 to 200 degrees Fahrenheit.

The oil is then at a suitable temperature for combustion and a portion thereof can be directed from the closed loop into the combustion oil supply line, at which time the linear actuator withdraws the pin from the nozzle orifice. The combustion oil is then fed into the atomizing gun body and through the center thereof by the small diameter combustion oil passage to the atomizing nozzle to be mixed with the atomizing air and ultimately injected into the combustion chamber, ignited and burned. Thus, a portion of the circulating oil is periodically removed for combustion from the circulatory system as is required, whereby such diversion is achieved by the use of a solenoid valve operated by the control system. In addition, the oil in the circulatory system and in the atomizing gun up to the point that it is injected into the combustion chamber, is maintained at a positive pressure of 30 psi.

When the thermostat in the heated space signals that the desired temperature has been reached combustion can then be stopped. In the present invention the solenoid valve controlling the diversion of oil from the closed loop circulation network is closed, the atomizing air is shut off and the oil heater is turned off. The linear actuator is simultaneously activated causing the pin to be inserted into the nozzle orifice resulting in the closure thereof. However, the pump continues to operate circulating oil through the closed loop network, including the nozzle body portion. This circulation is continued until the atomizing nozzle, and, in particular, the atomizing end thereof, cools, again by conduction to the now cooling oil, to a pre-set temperature, after which the pump is turned off.

A major advantage of the present invention concerns the closed loop circulatory system. Applicant herein recognized that localized heating of waste oil can cause the precipitation of particles sufficient to block the oil injection orifice. Thus, the continuous circulation of oil serves to reduce any such localized heating of oil and the resultant precipitate formation. Also, the filter is located downstream of the heater with respect to the direction of oil flow, and thereby provides additional means for eliminating unwanted particles that may otherwise form in the vicinity of the heater, as well as to remove any particles already present therein. It can also be seen that the circulation of oil in the tubular body of the atomizing gun at start-up, but prior to combustion, serves to warm the atomizing gun and any residual oil therein remaining from the previous firing. As waste oil must be heated before it will burn properly, a remote heat source, as seen in the prior art, will not serve to heat such residual oil in the gun. Therefore, this residual oil can be too viscous or cold to be properly atomized and ignited resulting in false starts and shut downs.

It can also be understood that the circulatory system provides for cooling of the atomizing gun during post-burn shut down. The prior art failed to appreciate the deleterious heat effects on the atomizing gun and the oil therein after combustion is stopped. In particular, after combustion there exists a heat-soak effect wherein the residual heat in the combustion chamber is conducted to the atomizing gun causing precipitate or tar formation of the oil therein resulting in blockage of the oil injecting orifice. In addition, such residual heat can cause the oil in the final delivery circuit to produce gas which can cause the oil to ooze from the oil orifice and create a vapor lock. Both situations can result in false starts and shut-downs. Thus, the circulating of the oil after shut-down of combustion, and particularly of the oil heater, allows the cooling of the atomizing gun by drawing off such latent heat.

A further advantage of the present invention concerns the maintaining of the oil in the circulatory system and the atomizing nozzle up to the point of injection at a pressure above atmospheric. Waste oil has the tendency to produce an essentially inflammable gas, particularly when heated. Prior art waste oil burning devices leave the oil at atmospheric pressure in the atomizing gun, and in some cases below atmospheric, as the result of siphoning of the oil into the gun from a reservoir source. As a result thereof, the production of gas is not inhibited, and in the case of siphoning delivery, is enhanced. Production of such inflammable gas can result in flame outage and shut-down. In the present invention the oil is pressurized to reduce this gas production to a level that does not have a substantial effect on the performance thereof.

A further advantage of the present invention concerns the use of a linear actuator. The cycling of the pin in and out of the oil orifice allows for a mechanical means for removing from the oil orifice any particles that may nevertheless form in spite of the other steps and precautions taken in the present invention to prevent such blockage. In addition, opening and closing the oil orifice serves to prevent oil leakage after shut-down and to maintain pressure. The pin also provides a positive safety element by mechanically closing the oil orifice at shut-down.

BRIEF DESCRIPTION OF THE DRAWINGS

Further objects and advantages of the present invention can be had in view of the following detailed description of the present invention which refers to the following figures, wherein.

DETAILED DESCRIPTION

Figure 1:
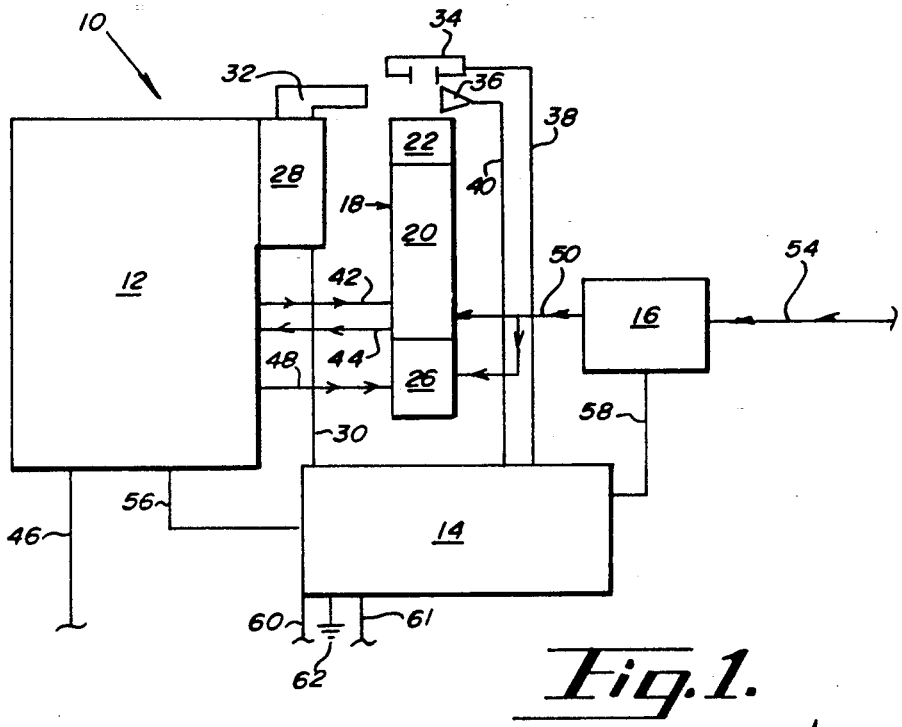
FIG. 1 shows a block diagram representation of the present invention.

The oil combustion system of the present invention is schematically represented in FIG. 1 and generally referred to as number 10. Combustion system 10 includes a hydraulic system 12, a control system 14 and a pneumatic system 16. The present invention also includes an oil atomizing gun 18 which includes a rectangular heat exchanging oil circulating body 20, and an oil atomizing nozzle portion 22 secured to one end of body 20. A linear actuating means 26 is secured to body 20 on an end thereof opposite from nozzle 22. An electrically operated blower 28 is connected by electrical line 30 to control system 14, and includes an air conduit means 32 for directing combustion air adjacent the immediate exterior of nozzle end 22 of gun 18. An electronic ignition means 34 and a flame sensing means 36 are electrically connected to control system 14 by lines 38 and 40 respectively. Hydraulic system 12 is fluidly connected by a circulating oil supply line 42 and a circulating oil return line 44 to body 20, and to a fuel oil reservoir or tank, (not shown), by fuel supply line 46. Hydraulic system 12 is also fluidly connected to actuating means 26 by a combustion oil supply line 48. Pneumatic system 16 is connected by a compressed air line 50 to body 20 and to linear actuator 26 and is connected to a source of compressed air, (not shown), by a compressed air supply line 54. As will be described in greater detail below, hydraulic system 12 and pneumatic system 16 include a variety of sensing and regulating means each of which is connected to control system 14 by separate electrical connections, which connections in FIG. 1 are cumulatively represented by lines 56 and 58 respectively. Control system 14 is connected to a conventional 120 volt fused/disconnect source of alternating current by lines 60 and 61, and to a ground 62.

Figure 9:
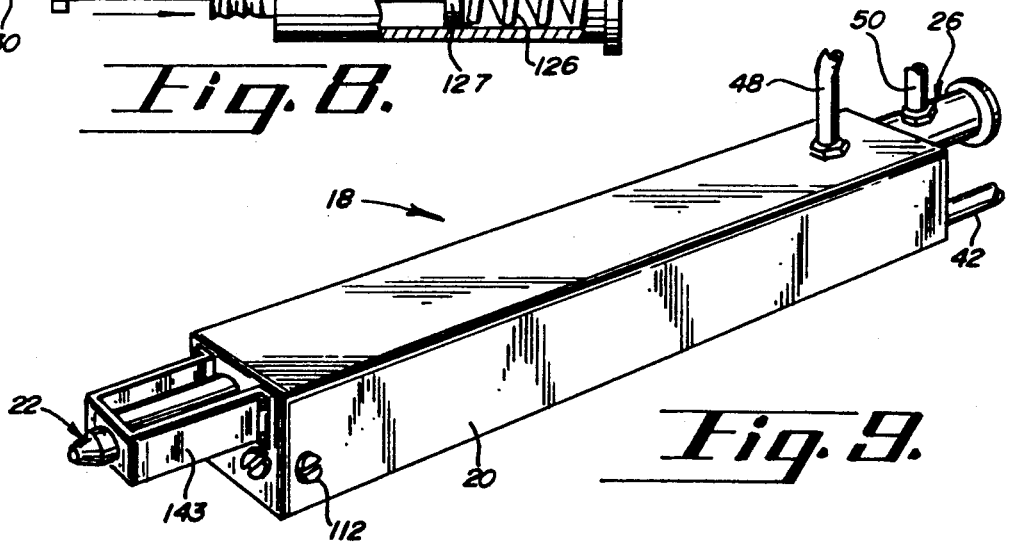
FIG. 9 shows a perspective view of the atomizing gun of the present invention.

Referring to FIG. 9, it can be seen that atomizing gun body 20 is rectangular having nozzle assembly 22 secured to one end thereof. Actuator 26 is secured to body 20 on the end thereof opposite from nozzle 22.

Figure 4:
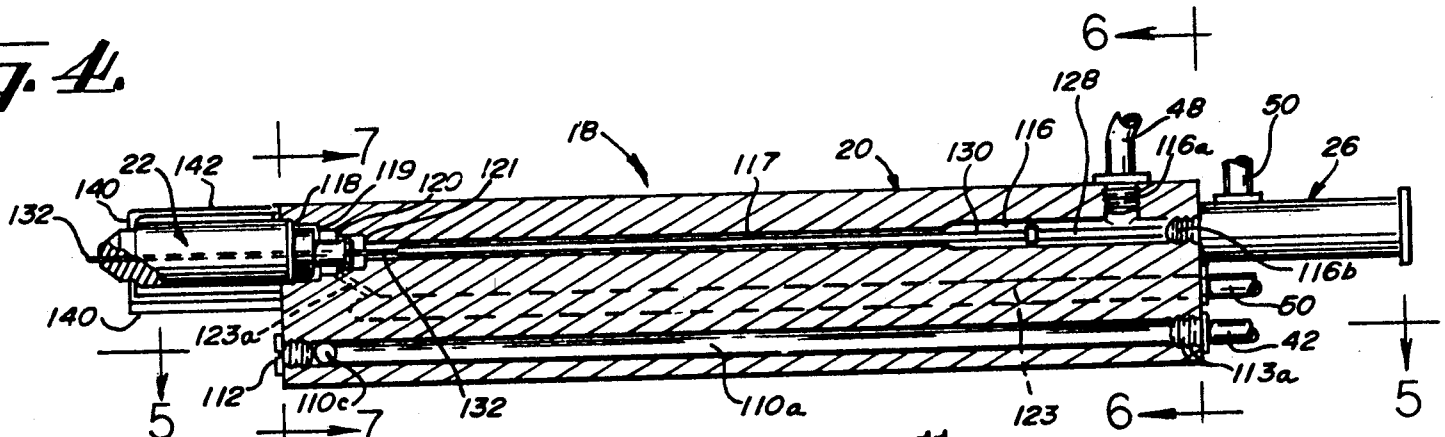
FIG. 4 shows a side plan view with portions cut away of the atomizing gun of the present invention.
Figure 10:
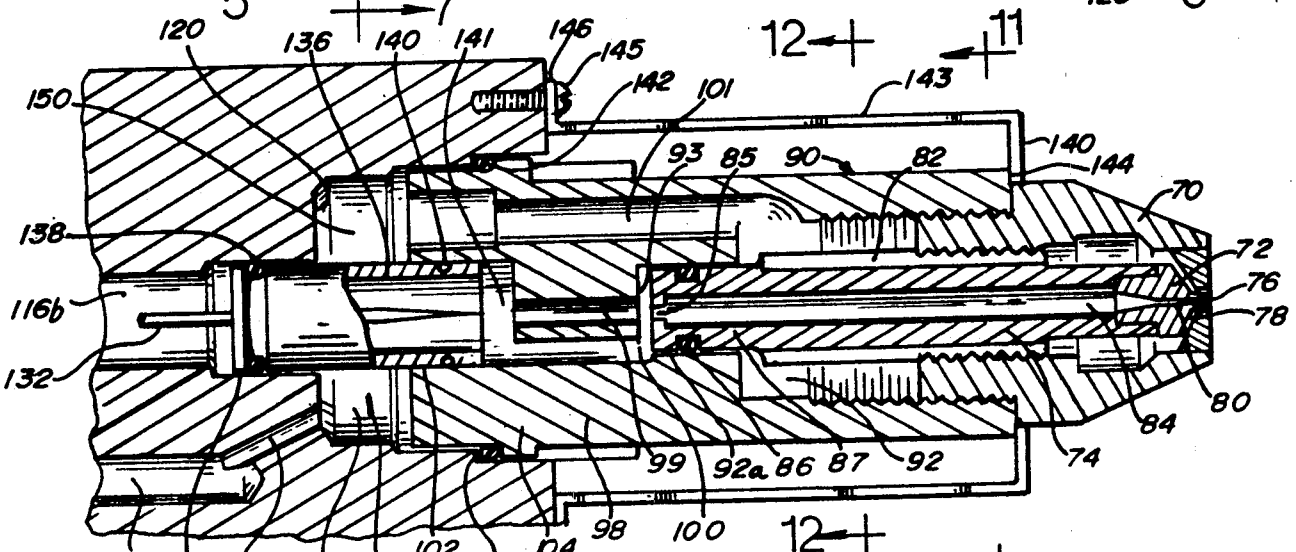
FIG. 10 shows an enlarged cross-sectional view of the atomizing nozzle of FIG. 4.
Figure 5:
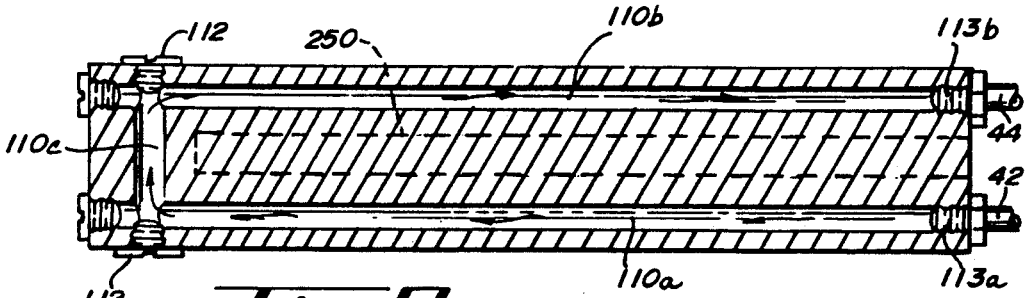
FIG. 5 shows a top plan view of the gun body along lines 5—5 of FIG. 4.

Referring to FIG. 10, nozzle assembly 22 can be understood by those of skill in the art to represent a modified nozzle of the DELEYAN type. The conventional components thereof include a nozzle end cap 70, an air swirl insert 72 and an internal fitting 74. As is known in the art, nozzle end cap 70 includes a central oil injection aperture 76, and insert 72 includes a plurality of air swirl channels 78 and a central oil aperture 80. As is also known, internal fitting 74 includes longitudinal ridges 82 projecting from the central surface thereof, a central oil delivery channel 84, an oil orifice 85 and an o-ring 86 extending around a reduced diameter end 87. Nozzle end cap 70 is shown in FIG. 4 threadably engaged with internal fitting 74 with insert 72 there between. As is also understood by those of skill, when internal fitting 74 is so engaged with nozzle end cap 70, air can flow through channels 78 towards injection orifice 76.

Figure 13:
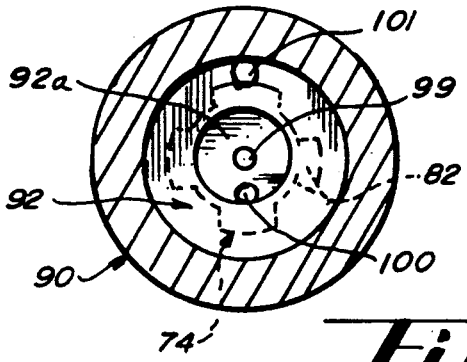
FIG. 13 shows a cross-sectional view of the atomizing nozzle body along lines 13—13 of FIG. 4 with the internal nozzle fitting indicated in ghost outline.
Figure 12:
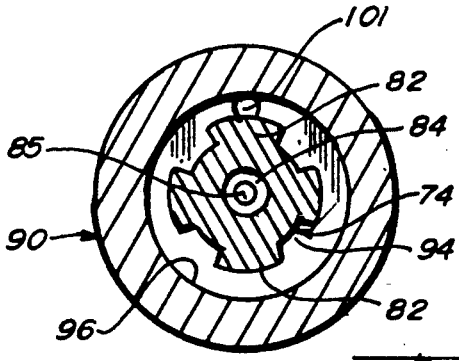
FIG. 12 shows a cross-sectional view of the atomizing nozzle body and internal nozzle fitting along lines 11—11 of FIG. 4.
Figure 11:
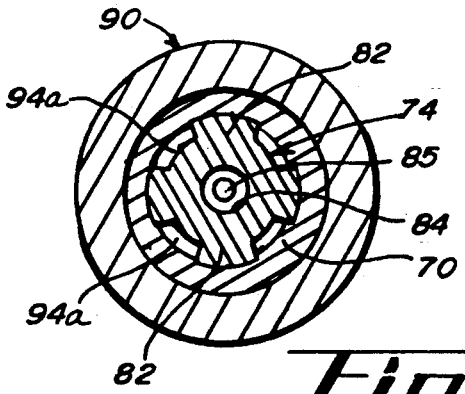
FIG. 11 shows a cross-sectional view of the atomizing nozzle body and internal nozzle fitting along lines 11—11 of FIG. 4.

End 70 and fitting 74 are in turn threadably engaged with a modified nozzle body 90. As seen by also referring to FIGS. 11, 12 and 13, nozzle body 90 includes a cavity 92 and a cavity recessed portion 92*a* for receiving internal fitting 74. Specifically, end 87 extends partially into recess 92*a* in a sealing manner with o-ring 86 creating an oil flow space 93. Moreover, an atomizing air flow channel 94 is then defined between internal fitting 74 and the interior surface 95 of cavity 92. Particularly referring to FIG. 11, as is known in the art, air passage 94 communicates with air channels 94*a* formed between ridges 82 and the interior surface of end cap 70. An orifice 96 extends through an end of fitting 74 and communicates with oil flow channel 84 extending through the center thereof. It will be appreciated that insert 72 extends partially into channel 84 at the end thereof opposite from orifice 96. Base end 98 of body 90 includes a central needle guide channel 99, a combustion oil channel 100 and an atomizing air channel 101 extending there through. End 98 also includes a recess 102 extending therein in a direction opposite from that of recess 92*a*, and an annular lip 104 around the exterior thereof.

Referring now to FIGS. 4, 5, 6, and 7, it can be seen that gun body 20 is a rectangular elongate block, preferably of a metallic material, such as aluminum, into which a variety of bores or passages have been drilled. Specifically, body 20 includes a U-shaped circulatory oil loop consisting primarily of two passages 110*a* and 110*b* displaced from each other in a common horizontal plane and extending substantially the length of body 20 and in fluid communication with each other through a short passage 110*c*. It will be understood by those of skill that plugs 112 provide for the blocking of orifices necessitated by the drilling of bores 110*a*, 110*b*, and 110*c*. Passages 110*a* and 110*b* terminate with threaded ends 113*a* and 113*b* for providing connection to circulating oil supply conduit 42 and circulating oil return conduit 44, respectively. A combustion oil delivery passage consists primarily of a first large diameter portion 116 in fluid communication with a second smaller diameter portion 117. Large diameter passage 116 includes a threaded opening 116*a* for coupling with combustion oil supply line 48, and an opening 116*b* for providing threaded engagement of pneumatic linear actuator 26 with body 20. Portion 116 is in fluid communication with a nozzle receiving recess, generally designated 118, including annular shoulders 119, 120, and 121. An atomizing air passage 123 extends along the length of and within body 20. Passage 123 is connected on one end with pressurized air supply conduit 50 and, includes an angled reduced diameter channel portion 123*a* on its other end extending to and terminating on annular shoulder 120 for providing air communication thereto.

Figure 8:
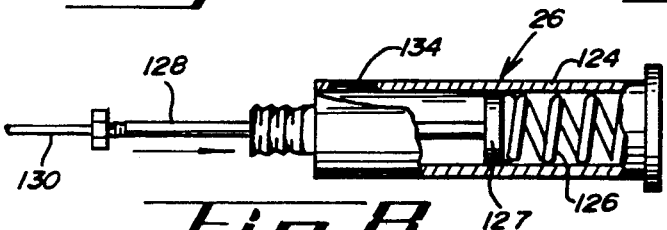
FIG. 8 shows a partial cross-sectional view of the linear actuator of the present invention.

As seen in FIG. 8, actuator 26 is an air pressure activated type, of the type, as for example made by Incom International, Inc., of Quincy, Mass., and includes an outer housing 124 enclosing a spring 126 and a piston 127 connected to a piston rod 128. Rod 128 extends through a gland, not shown, in housing 124, and into large passage 116, and terminates therein. An actuating rod 130 is threadably connected to piston rod 128 and extends through small diameter passage 117, and is, in turn, secured to an oil orifice needle 132. Needle extends into nozzle 22 and terminates therein adjacent oil injection aperture 76. Actuator 26 includes a threaded opening 134 for providing coupling to compressed air supply conduit 50.

A more complete understanding of the manner of attachment and interaction of nozzle 22 and gun body 20 can now be had. As seen in FIG. 10, nozzle end 98 is inserted into recess 118 wherein there exists a tube or gland 136. One end of tube 136 extends into recess 118 adjacent shoulder 121 and is held therein in sealing engagement by o-ring 138. The opposite end of tube 136 is inserted partially into recess 102 and is held in sealing engagement therein by a second o-ring 140, creating an oil space 141. Nozzle 22 is in sealing engagement with recess 118 by O-ring 142 being pressed between annular shoulder 119 and annular lip 104. Nozzle 22 is secured to body 20 by a bracket 143 engaged with nozzle end shoulder 144, and secured to body 20 by a plurality of screws 145 extending through bracket feet 146 and into threaded holes 148. It can be appreciated that nozzle end 98 terminates adjacent shoulder 120 and defines an air space 150 providing communication between atomizing air channel 123*a* and atomizing air channel 101.

Figure 2:
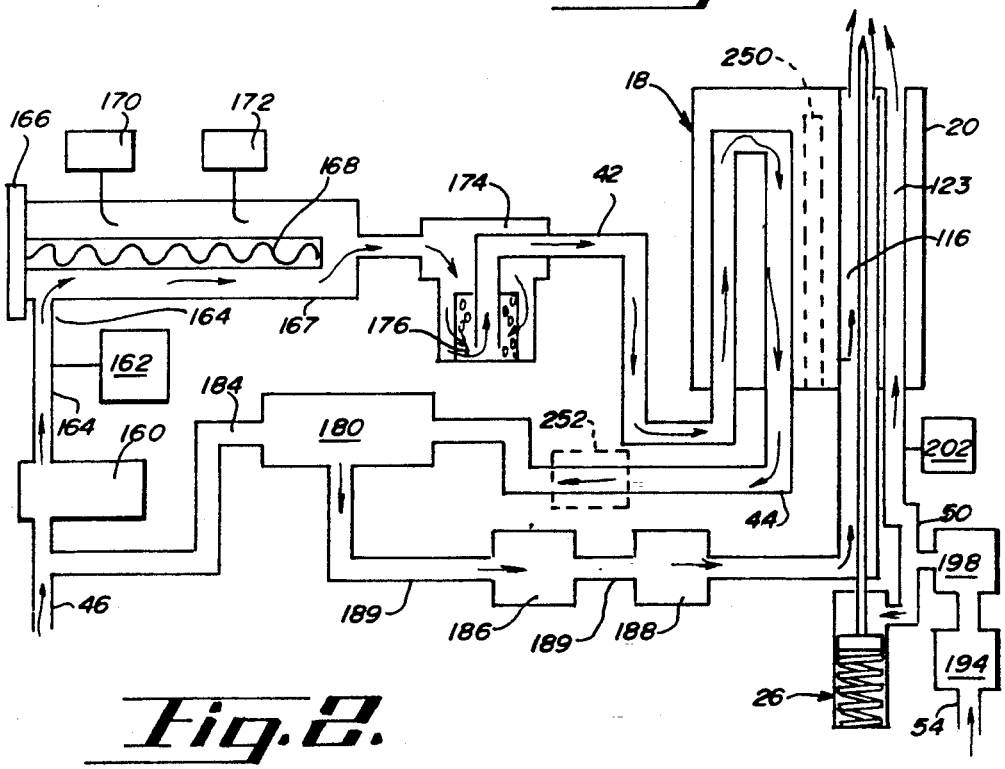
FIG. 2 shows a schematic representation of the hydraulic and pneumatic system of the present invention.

Hydraulic system 12 and pneumatic system 16 can be understood in greater detail by reference to the schematic diagram thereof in FIG. 2. System 12 includes an oil pump 160 in fluid communication with a oil reservoir, not shown, by conduit 46 and with an oil pressure sensor 162 by a conduit 164. Conduit 164 also provides for fluid communication from sensor 162 to an oil heater 166. Heater 166 includes an outer housing 167 within which oil is supplied by connection with conduit 164. An oil heating element 168 is also enclosed within housing 167. An oil temperature control switch 170 and an oil temperature proving switch 172 are in fluid communication with the oil within housing 167, and housing 167 is in fluid communication with an oil filter unit 174. Unit 174 contains an oil filter element 176 of the automotive type and is in fluid communication with atomizing gun body 20 by circulating oil supply conduit 42 connected to circulating oil flow passage 110*a*. Gun body 20 is in turn in fluid communication with a relief valve 180 by return conduit 44 connected to and extending between valve 180 and circulating oil flow passage 110*b* of gun body 20. Valve 180 is fluidly connected to supply conduit 46 by a conduit 184 extending there between. The relief port of valve 180 is connected to a solenoid valve 186, and valve 186 is, in turn, in fluid communication with a regulator valve 188. Combustion oil delivery conduit 48 provides for fluid communication of oil for combustion from valve 188 to combustion oil delivery passage 116.

Compressed air is supplied by conduit line 54 to air filter 194. Filter 194, is, in turn, connected by line 54 to a solenoid valve 198. A line 50 provides for air communication from valve 198 to opening 134 of actuator 26 and to atomizing air delivery channel 123 of gun body 20. An air pressure sensing switch 202 is connected to and senses the pressure in line 50.

Figure 3:
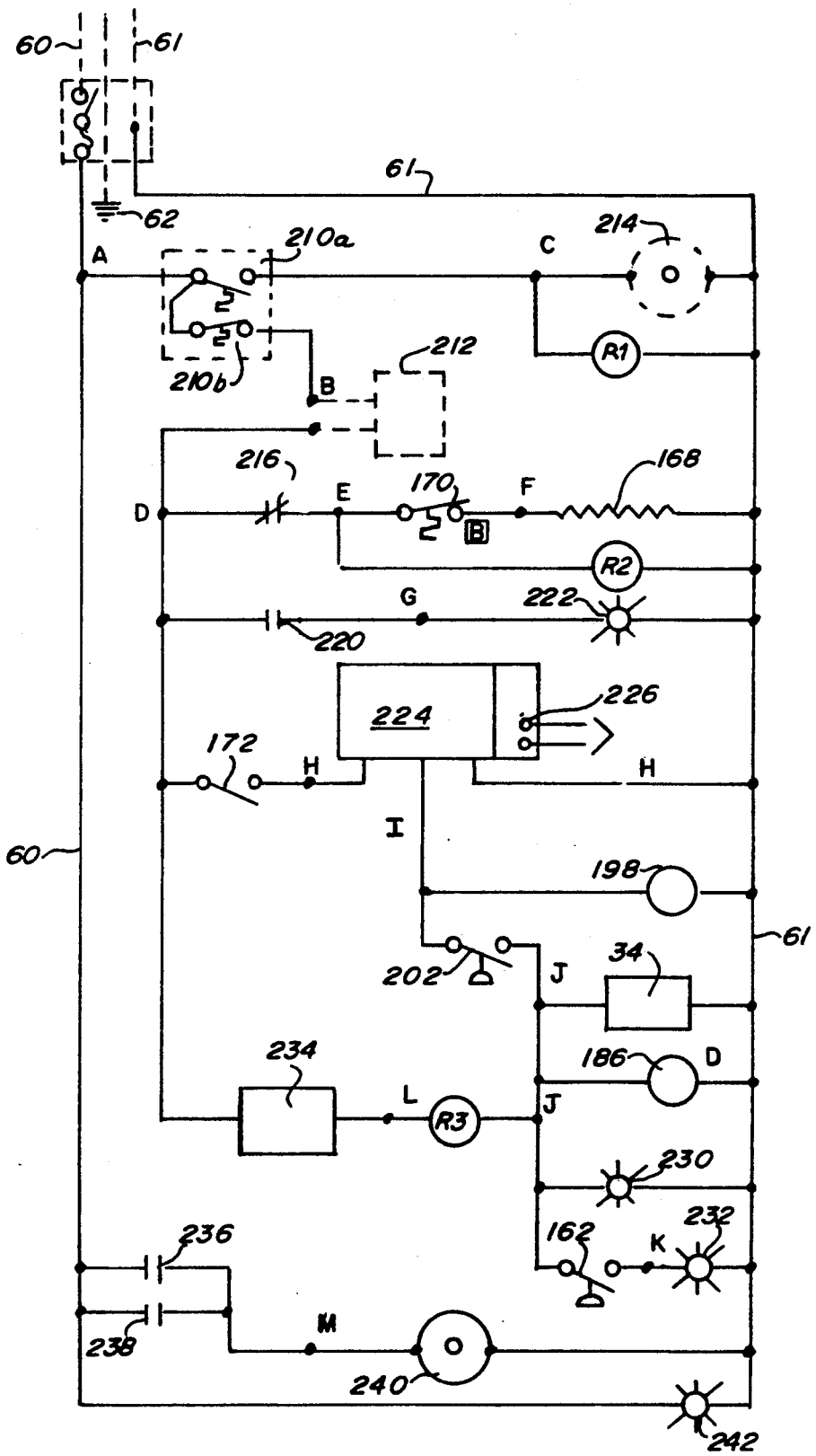
FIG. 3 shows a schematic representation of the control system of the present invention.

The control system 14 of the present invention is seen in schematic form in FIG. 3, wherein line 60 will be understood to be the power carrying line of an alternating current source, and line 61 will be understood to be the common or return line of that current source. To facilitate an understanding of the operation of control system 14 certain components, not a part of the present invention, are included in FIG. 3 and are indicated in dashed lines. Also, control system 14 includes three relays R1, R2, and R3 indicated as such in the circuitry to show their point of power connection. However, to simplify the schematic representation of system 14, the contact switches operated by the various relays are shown at the points in the circuitry over which control of the circuit is exerted by the relays, without showing the particular electrical connections there between.

A line A provides current to a circulating air fan high limit switch 210 which includes a thermostatically controlled normally open switch 210*a* and a normally closed thermostatically controlled safety high limit switch 210*b*, and is in turn connected by a line B to a thermostat 212 and to a line C. Line C provides current to a relay R1 connected in parallel with a circulating air fan motor 214. A line D provides current from thermostat 212 to a normally closed switch 216 of relay R3. A line E connects normally closed switch 216 to thermostatically controlled switch 170, and to relay R2. Switch 170 is normally closed and designed to open at temperatures above 230 degrees Fahrenheit. A line F provides connection between switch 170 and electrical element 168 of heater 166. Line D is also connected to normally open switch 220 of relay R3 and from switch 220 to a line G. Line G provides power to a red warning indicating light 222. Line D is further connected to temperature interlock switch 172, which is in turn connected to a combustion control 224 by a line H. Control 224 is connected to flame sensor 36 by terminals 226 and to line 61 by line H. Control 224 is also connected by a line I to solenoid valve 198 and air pressure switch 202. Switch 202 is connected to a line J, which line J, provides current in a parallel manner to ignition electrodes 34, combustion oil solenoid valve 186, a green operating indicating light 230, and oil filter pressure switch 162. Switch 162 is connected by a line K to an amber dirty filter indicating light 232, and in turn to line 61. Returning again to line D, line D also provides current to a timed make relay 234 which relay is connected by a line L to relay R3. Relay R3 seeks its ground by connection to line J. Line 60 provides power to normally open switches 236 and 238 operated by relays R1 and R2 respectively, and which switches are connected in parallel to a line M. Line M provides current to a combustion motor 240. It will be understood that motor 240 serves to operate combustion air blower 28 and oil pump 128. Line 60 also provides power to a white current indicating light 242.

The operation of the present invention can be appreciated wherein thermostat 212 provides current to line D upon sensing a need for heat. As is conventional in the art, current will be supplied to thermostat 212 through high limit switch 210*b*. Power will then be supplied through switch 216 to relay R2. Relay R2, then closes switch 238 causing motor 240 to run, thus operating pump 160 and combustion air blower 28. It can be appreciated that the oil will then flow in a circulatory manner, as best seen by referring to FIG. 2, from pump 160 through heater 166, through filter 174 into channels 110*a–c* of body 20 of atomizing gun 18, and returned from gun 18 through line 48 to valve 180 and ultimately back again to pump 160 to again pass through the same circulatory loop. Simultaneously with the running of pump 160, current is supplied to heating element 168 of heater 166 through switch 170, assuming the temperature of the oil being below 230 degrees Fahrenheit. It can now be understood that the oil is continuously circulated as it is being heated, which also provides for the convection heating of gun body 20 and nozzle 22 by the flow of the heated oil within body portion 20. The filter 174 being located downstream with respect to the direction of oil flow from heater 166 serves to pickup any particles that may be produced around the immediate vicinity of the heater as the result of heating of the oil. This strategy guards against blockage of the fine combustion oil passages in nozzle 20 of such particles to the extent that any such may occur despite the continual circulation of the oil past heater 166. Upon sensing that the oil has reached a temperature suitable for combustion, approximately 180 degrees Fahrenheit, switch 172 closes and provides current to combustion control 224. Combustion control 224, providing no flame is sensed by photo sensitive sensor 36, then directs current to line I. Air solenoid valve 198 is first energized thus providing pressurized air to line 50. Air is further simultaneously directed to linear actuator 26 whereby the action of the air on piston 127 against spring 126 results in movement of rods 128 and 130 in the direction of the arrow as indicated in FIG. 8, and thus, the retraction of needle 132 from insert channel 80 as is represented in FIG. 10. In addition, pressure sensor switch 202 closes when suitable air pressure is reached thereby allowing current flow to oil solenoid 186. Oil is then diverted from the circulatory loop through regulatory valve 188 to gun body 20 to be sprayed out of orifice 76 into a suitable combustion chamber. In particular, referring to FIG. 10, the retraction of needle 132 permits oil to flow into passage 116 and then along passage 117. The oil then passes, in order, through short tube 136 into space 141, through nozzle body oil channel 100 into oil space 93, through internal fitting oil delivery channel 84 into insert channel 80 to ultimately be ejected from nozzle injection aperture 76. Essentially simultaneously with the direction of oil for combustion as just described, pressurized air is also directed to gun 18 to provide for atomization of the oil injected into the combustion chamber. Specifically, pressurized air is directed to passage 123 and flows there along and through passage portion **123*a* into air space 150 created between shoulder 120 and nozzle base end 98. The air then flows through nozzle body channel 101 into air space 94, and from space 94 through channels 94*a* into channels 78 to ultimately mix in a swirling manner with the oil upon injection thereof into the combustion chamber. Also simultaneously, ignition electrodes are energized resulting in ignition of the air/oil mixture. It will be understood by those of skill, that as oil is burned it will be replaced by the uptake thereof by pump 160 through conduit 46** connected to a suitable tank or reservoir supply.

When a suitable temperature is reached in the combustion chamber switch **210*a* is closed and circulating fan 214 is energized resulting in the direction of air to the space being heated. When thermostat 212 detects the desired heat increase, power to line D is interrupted and all of the various components, sensors, and so forth, deriving power directly or indirectly therefrom, are shut off. In particular, heater 166 is turned off, air pressure is removed from actuator 26 causing needle 132 to be re-inserted into channel 80, and solenoid valve 186 closes stopping the diversion of oil for combustion from the circulatory loop to gun 18**. As a result thereof combustion of oil ceases.

However, it will be understood that switch **210*a* will continue to be closed for a period of time after the shut-down of combustion due to the residual heat in the combustion chamber which needs to be removed therefrom by the action of fan 214. It can now be seen that relay R1 being in parallel connection with fan 214 will continue to be energized after shut-down thereby keeping switch 238 closed. Power will then continue to be supplied to motor 240 during this cool down of the combustion chamber. As a result thereof, pump 160 will continue to operate. Thus, oil will continue to circulate in the circulatory loop, and, as heater 166 is off, this circulation will provide for cooling of gun body, and by convection, nozzle 22. This cooling is needed to prevent the thickening or coagulating of residual oil in gun body 20 and nozzle 22** that can occur as the result of the heat soak thereof from the heat remaining in the combustion chamber after shut-down.

It can now be appreciated that the control system of the present invention provides for four operational stages that can be designated as; off; circulatory oil pre-heating; oil-burn; and post-burn cool down.

An important safety aspect of the present invention can be seen with respect to timed make relay 234 and relay R3. Connection of relays 234 and R3 in series to line D and then to line J results in current being initially supplied thereto when thermostat 212 calls for heat. However, at this initial point line J will not be energized as the oil must first be raised to a suitable combustion temperature prior to which switch 172 will be open, and therefore, no current will be supplied to control 224 and ultimately to line J. As relays 234 and R3 require very little current, electrodes 36 and valve 186 will provide adequate ground for their operation. However, relay 234 is set for a time period of five minutes during which it will not provide current to relay R3. If within this five minute period switch 172 energizes control 224 and the ignition sequence is started it can be seen that line J will be energized and reach the same potential as line D. As a result thereof, relay 234 will cease to operate, as no net current will flow there through due to this equal potential of lines D and J. If however, this five minute interval expires without line J being energized relay R3 will receive current causing switch 216 to open and switch 220 to close. Thus, heater 168 will be shut off and relay R2 will lose power causing switch 238 to open, turning off motor 240, and providing current to warning indicator light 222. It will be appreciated by those of skill that relays 234 and R3 provide a safety control in the situation wherein ignition does not occur and it may be desirable to stop the operation of pump 160 and heater 166. For example, a rupture in the circulatory loop could result in no ignition, and thus, a shut down of lines I and J by control 224. However, if pump 160 and heater 166 were allowed to continue operating a potentially dangerous or damaging situation could result from a flow of oil from the system.

A further feature of the present invention concerns the maintenance of the oil at a pressure of approximately 10 psi in the circulatory system and in the combustion oil circuit. This pressure is accomplished by valves 180 and 188 respectively, and serves to maintain the oil at such pressure until it exits orifice 76. In this manner, gassing-off of the oil is prevented. The gasses produced by waste oil are typically not capable of supporting combustion and often cause unwanted flame outage.

Another feature of the present invention concerns the modified atomizing gun 18 wherein needle 132 is provided to allow for mechanical cleaning of the nozzle assembly thereof after each heating cycle as a result of the repeated linear movement thereof. Thus, any blockage that may occur, particularly in the small orifices and passages in nozzle 22, will be removed by such action. In addition, needle 132 provides for a safety closing of channel 80 at shut-down so that oil will not flow from nozzle 22 unless combustion is occurring. It can be appreciated that nozzle body 90 has been particularly designed to provide for the proper guiding of needle there through and into insert 70. In addition, the interaction of nozzle body 90, tube 136 and gun body 20, allow for such use of a needle in nozzle 22 while providing for the isolation of combustion oil from the atomizing air up to the point just prior to injection.

An important feature of the present invention concerns the construction of gun body 20. The various oil air and oil delivery and combustion channels consist of bores that have been drilled into an originally solid block of aluminum. This construction provides for a gun body that is relatively inexpensive to manufacture, that is highly reliable, and minimizes the number of separate elements needed to form the entire gun 18.

Figure 6:
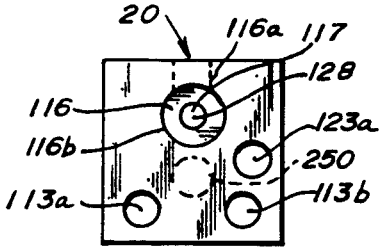
FIG. 6 shows an end view of the atomizing gun body along lines 6—6 of FIG. 4.
Figure 7:
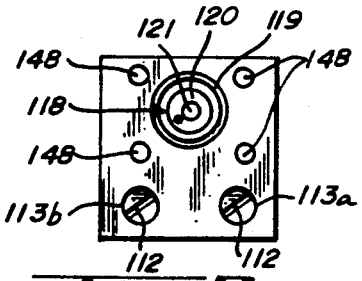
FIG. 7 shows an end view of the atomizing gun body along lines 7—7 of FIG. 4.

In an alternative embodiment of the present invention heating of the oil can also be accomplished in lieu of heater 166 with a heater 250 located in gun body 20. Specifically, heater 250 is inserted in block 20 centrally thereof and substantially along the entire length thereof, as indicated in outline in FIGS. 2 and 3, and as seen in FIG. 6. Thus, heater 250 provides for heating of the oil as it is being circulated by conduction thereto through gun body 20. A filter 252, indicated in outline in FIG. 2 would also be necessary in this alternate embodiment to be located in a downstream position with respect to heater 250. Thus, filter 252, identical with filter 174 and used in place thereof, is located, for example, on conduit 44 to provide for the downstream positioning. It will be understood by those of skill in the art that switches 170 and 172 would, in this alternate embodiment, be located for example in equivalent positions in conduit 164. This heater positioning can provide for quicker heating of gun 18 and for a somewhat more compact arrangement of the components of the present invention.

It can also be seen that the continual circulating of the oil during heating thereof reduces the chances of localized overheating of the oil. Thus, damaging particulate matter production or agglomerate formation is reduced. In addition, pressure indicating switch 162 is provided to check the pressure in the circulatory system. A high pressure in excess of 50 psi indicates theat filter element 176 is filled with particulate matter and should be changed. The connection of pressure switch to line K insures that switch 162 is not activated unless the oil has first been heated. Otherwise, switch 162 would give false signals by activating light 232 as the cold oil at start-up would give an initially high pressure reading that would not be properly indicative of a dirty filter.

Air filter 194 provides for cleaning of the air delivered to actuator 26 and gun 18 to reduce any contamination thereof. Air regulator valve 198 provides for the regulating of the delivered air pressure to allow for various operating parameters. In a similar manner, and in coordination therewith, oil pressure regulator valve 188 can provide for the regulation of oil pressure in the circulatory and combustion circuits to allow for tuning the present invention for particular operating conditions, such as rate of burn and the particular condition of the oil being combusted.

The present invention is contemplated for us in small business locations, such as service stations and the like where waste oil is generated which could then provide for space heating. Thus, the invention herein is currently designed to produce heat in the range of 100,000 to 300,000 BTU's per hour. This size range is particularly as the result of the United States Environmental Protection Agency requirement that waste oils not be burned at any one location in excess of 500,000 BTU's per hour due to combustion product dispersal considerations. A 100,00 to 300,000 BTU burning rate would translate into a gallons per hour (GPH) flow rate in the combustion oil circuit of from approximately 1.0 to 3.0 GPH, and a flow rate of approximately 18 GPH in the circulatory loop.

Another important feature of the present invention concerns the maintaining of pressure in both the circulatory loop and the combustion circuit along with the constant circulation of the oil. In this manner, the oil can be heated to a temperature well in excess of its boiling point whereby various viscosities and/or burning characteristics of the particular fuel can be allowed for. For example, it is contemplated that other types of fuel sources can be utilized by the present invention, such as, vegetable oils. Large quantities of such oils are produced by restaurants, and the like, and, as with petroleum oils, can present a substantial disposal problem. The location of a downstream filter can also serve to permit such higher temperature operating conditions by catching any particles that may form as a result of the heating of the fuel prior to combustion thereof.

The present invention has been described herein as including various specific structures. However, it will be apparent to those of skill that various modifications or rearrangements of the described parts can be made without departing from the spirit and scope of the underlaying inventive concept. Thus, the present invention is not limited to the particular form or forms shown and described herein, reference is directed to the appended claims for a determination of the scope thereof.

What is claimed is:

1. A device for burning waste oil, and the like, through atomization and ignition thereof in a suitable combustion chamber, comprising: a closed loop oil circulating system, the circulating system including an oil circulating conduit the conduit having a pump for pumping the oil there through and a heater for heating the oil as it is circulated by the pump, an atomizing gun, the gun including a heat exchange oil channel, the heat exchange channel in fluid communication on each end thereof with the circulatory conduit and forming a portion of the closed loop circulatory system so that the oil can flow to and subsequently away from the gun as it circulates through the circulatory system, and the atomizing gun having a combustion oil channel regulatably connected to the circulating system by a combustion oil system, the combustion system including a combustion oil conduit in fluid communication with the circulatory conduit and valve means for regulatably diverting oil from the circulatory conduit to the combustion oil channel, and the atomizing gun including a nozzle assembly, the nozzle assembly in fluid communication with the combustion oil channel and with a pressurized air conduit providing pressurized air from a source thereof for providing atomizing of the combustion oil and injection thereof from an oil injection orifice of the nozzle assembly into the combustion chamber, and the diverting valve means permitting circulating of the oil through the circulating system separately from the diversion of oil therefrom to the combustion oil channel.

2. The waste oil burning device as defined in claim 1, and the circulating system including relief valve means for maintaining the oil within the circulating system at a pressure above atmospheric suitable for resisting the production of gasses from the oil.

3. The waste oil burning device as defined in claim 2, and the combustion system including regulating valve means for maintaining the oil within the combustion oil channel at a pressure above atmospheric suitable for resisting the production of gasses from the oil.

4. The waste oil burning device as defined in claim 1, and the atomizing gun further including an elongate heat exchange gun body portion connected to the nozzle assembly, and the circulating channel extending through the body portion.

5. The waste oil burning device as defined in claim 4, and the combustion oil channel extending through the gun body.

6. The waste oil burning device as defined in claim 5, and the gun body portion including an atomization air channel extending there through for providing fluid communication of pressurized atomizing air from the pressurized air conduit to the nozzle assembly.

7. The waste oil burning device as defined in claim 1, and further including means for mechanically cleaning the injection orifice of the gun nozzle assembly.

8. The waste oil burning device as defined in claim 7, and the mechanical cleaning means including a linear actuator secured to the gun body portion, the linear actuator having a rod connected thereto and extending along and within the combustion oil channel and terminating with a needle end for releasable insertion of the needle end through the nozzle assembly and into the injection orifice thereof for blocking the injection orifice by operation of the linear actuator when combustion is not desired and retracting from and opening the injection orifice by operation of the linear actuator when combustion is desired.

9. The waste oil burning device as defined in claim 8, and the nozzle assembly including atomizing air channel means and combustion oil channel means for directing the flow of pressurized air and combustion oil there through respectively in a manner that prevents the mixing of the combustion oil and pressurized air until injection thereof out of the injection orifice into the combustion chamber, and the nozzle assembly including a needle guide channel means for guiding the needle end there through to the injection orifice.

10. The waste oil burning device as described in claim 9, and further including means for providing for releasable securing of the nozzle assembly to the gun body portion, the securing means including tube means for allowing coupling of the atomizing air channel of the body portion to the air channel means of the nozzle assembly and coupling of the combustion oil channel of the body portion to the oil channel means of the nozzle assembly in a manner that provides for the isolation of the combustion oil and the atomizing air and that permits the insertion and operation through the tube means of the needle end.

11. The waste oil burning device as defined in claim 1, and further including a control system, the control system including electrical connections to a heat sensing means for sensing the temperature of the oil in the circulatory system, and the control means connected to the pumping means and the heater of the circulatory system and further connected to the diverting valve means of the combustion oil system for first providing for operation of the pumping means and heater to allow for heating of the oil and heating of the atomizing gun and nozzle assembly by circulation of the heated oil in the circulating oil channel of the atomizing gun to a predetermined optimal oil combustion temperature as detected by the heat sensing means so that the diverting valve means can not be operated to provide oil to the combustion oil conduit unless such predetermined temperature is first reached.

12. The waste oil burning device as defined in claim 11, and the control system further having operational control of the linear actuating means and of a pressurized air control valve means connected to the pressurized air conduit for providing a substantially simultaneous flow of combustion oil and atomizing air towards the oil injection orifice of the nozzle assembly for injection of atomized oil into the combustion chamber when combustion is desired and when the predetermined combustion temperature has been reached.

13. The waste oil burning device as defined in claim 12, and the linear actuator operated by pressurized air and connected to the pressurized air conduit and controlled by operation of the pressurized air control valve means.

14. The waste oil burning device as defined in claim 12, and the control system further including control means for turning off the oil heater of the circulating system when combustion is stopped and for continuing the operation of the pump and circulation of oil in the circulating system for a period of time after combustion has ceased for providing cooling of the atomizing gun and the nozzle assembly by the flow of oil through the circulatory channel of the atomizing gun.

15. The waste oil burning device as defined in claim 1, and a filter located on the circulatory system at a position thereon downstream of the heater.

16. A device for burning waste oil, and the like, through atomization and ignition thereof in a suitable combustion chamber, comprising: a closed loop oil circulating system, the circulating system including a circulating conduit the conduit having a pump for pumping the oil there through, a heater for heating the oil as it is circulated by the pump, and a filter for filtering the oil as it is being circulated, an atomizing gun, the gun including a nozzle assembly and the nozzle assembly having an oil injection orifice and the nozzle assembly having means for mixing the oil with atomizing air for injecting of the air-oil mixture into the combustion chamber, and the atomizing gun further including an elongate heat exchange gun body portion connected to the nozzle assembly, and the body portion including a circulating channel therein connected to the circulating system so that oil is circulated through the body portion, and the gun body portion including a combustion oil channel extending there through for providing fluid oil communication to the nozzle assembly for delivering combustion oil thereto, and the gun body portion including an atomization air channel extending there through for providing fluid communication of pressurized atomizing air to the nozzle assembly, and the circulating system including relief valve means for maintaining the oil within the circulating system at a pressure above atmospheric suitable for resisting the production of gasses from the oil, and the atomizing gun connected to the circulating system by a combustion oil system, the combustion system including a combustion oil conduit connected to the combustion oil channel of the gun body portion and the combustion conduit having control valve means for diverting oil from the circulatory loop to the nozzle assembly of the gun body portion through the combustion oil channel thereof, and the combustion system including regulating valve means in the combustion oil conduit for maintaining the oil within the combustion system at a pressure above atmospheric suitable for resisting the production of gasses from the oil, and a pressurized air conduit connected to the pressurized air channel of the gun body portion for providing pressurized air to the nozzle assembly for atomization of the oil, and a control system, the control system including electrical connections to a heat sensing means of the circulatory system, the pumping means and the heater of the circulatory system and to the diverting valve means of the combustion oil system for first providing for operation of the pumping means and heater to allow for heating of the oil and heating of the gun body portion and nozzle assembly by circulation of the heated oil in the circulating oil channel of the gun body portion to a predetermined optimal oil combustion temperature as detected by the heat sensing means so that the diverting valve means can not be operated to provide oil to the combustion oil conduit unless such predetermined temperature is first reached, and the control system further having operational control of the actuating means and of a pressurized air control valve means connected to the pressurized air conduit for providing a substantially simultaneous flow of combustion oil and atomized air to and out of the nozzle assembly and into the combustion chamber when combustion is desired and when the predetermined combustion temperature has been reached, and the control system further including control means for turning off the oil heater of the circulating system when combustion is stopped and for continuing the operation of the pump and circulation of oil in the circulating system for a period of time after combustion has ceased for providing cooling of the gun body portion and the nozzle assembly by the flow of oil through the circulatory channel of the gun body portion, and having mechanical cleaning means including a linear actuator secured to the gun body portion, the linear actuator having a rod connected thereto and extending along and within the combustion oil channel and terminating with a needle end for releasable insertion of the needle end through the nozzle assembly and into the injection orifice thereof for blocking the injection orifice by operation of the linear actuator when combustion is not desired and retracting from and opening the injection orifice by operation of the linear actuator when combustion is desired.

17. The waste oil burning device as defined in claim 16, and the nozzle assembly including atomizing air channel means and combustion oil channel means for directing the flow of pressurized air and combustion oil there through respectively in a manner that prevents the mixing of the combustion oil and pressurized air until injection thereof out of the injection orifice into the combustion chamber, and the nozzle assembly including a needle guide channel means for guiding the needle end there through to the injection orifice.

18. The waste oil burning device as described in claim 17, and further including means for providing for releasable securing of the nozzle assembly to the gun body portion, the securing means including tube means for allowing coupling of the atomizing air channel of the gun body portion to the air channel means of the nozzle assembly and coupling of the combustion oil channel of the gun body portion to the oil channel means of the nozzle assembly in a manner that provides for the isolation of the combustion oil and the atomizing air and that permits the insertion and operation through the tube means of the needle end.

19. The waste oil burning device as defined in claim 16, and the linear actuator operated by pressurized air and connected to the pressurized air conduit and controlled by operation of the pressurized air control valve means.

20. The waste oil burning device as defined in claim 16, and the filter located at a point on the circulatory system in a direction downstream of the flow of oil with respect to the heater.

21. A method of burning waste oil by injection thereof from an atomizing gun into a suitable combustion chamber, the steps comprising: circulating the oil in a closed loop circulating system wherein the atomizing gun forms a part of the circulating system for being in heat exchange relation there with so that oil can be circulated to and away from the atomizing gun as it circulates through the circulating system, heating the oil to a temperature suitable for combustion thereof as the oil is being circulated in the circulating system, sensing the temperature of the oil in the circulating system, diverting a portion of the oil from the circulating system to the atomizing gun when it is sensed that the oil has reached the suitable combustion temperature, atomizing the oil delivered to the atomizing gun by injecting the oil into the combustion chamber with pressurized air through an injection orifice of an injection nozzle of the atomizing gun, igniting the atomized oil for combustion thereof in the combustion chamber, continuing the circulating of oil in the circulatory system during the combustion of oil in the combustion chamber, stopping the diversion of oil to the atomizing gun when it is desirable to end combustion, and permitting circulating of the oil through the circulating system separately from the diversion of oil therefrom to the combustion oil channel.

22. The method as defined in claim 21, and further including the steps of stopping the heating of the oil in the circulating system after combustion has been stopped, and circulating the oil through the circulatory system for a suitable period of time after combustion has been stopped for allowing cooling of the atomizing gun.

23. The method as defined in claim 22, and including the step of mechanically cleaning the injection orifice just prior to igniting of the oil by retracting a needle end of a rod from the nozzle injection orifice, the rod connected to automatically operable linear actuating means for providing motion thereof for retracting the needle end.

24. The method as defined in claim 23, and including the step of mechanically cleaning the injection orifice when it is desirable to end combustion by operating the linear actuating means for inserting the needle end of the rod into the nozzle injection orifice.

25. A device for burning waste oil, and the like, through atomization and ignition thereof in a suitable combustion chamber, comprising: a closed loop oil circulating system, the circulating system including an oil circulating conduit the conduit having a pump for pumping the oil there through and a heater for heating the oil as it is circulated by the pump, an atomizing gun, the gun including a heat exchange oil channel, the heat exchange channel in fluid communication on each end thereof with the circulatory conduit and forming a portion of the closed loop circulatory system so that the oil can flow to and subsequently away from the gun as it circulates through the circulatory system, and the atomizing gun having a combustion oil channel regulatably connected to the circulating system by a combustion oil system, the combustion system including a combustion oil conduit in fluid communication with the circulatory conduit and valve means for regulatably diverting oil from the circulatory conduit to the combustion oil channel, and the atomizing gun including a nozzle assembly, the nozzle assembly in fluid communication with the combustion oil channel and with a pressurized air conduit providing pressurized air from a source thereof for providing atomizing of the combustion oil and injection thereof from an oil injection orifice of the nozzle assembly into the combustion chamber, and the diverting valve means permitting circulating of the oil through the circulating system separately from the diversion of oil therefrom to the combustion oil channel, and including an automatically operable linear actuator secured to the gun body portion, the linear actuator having a rod connected thereto and extending along and within the combustion oil channel and terminating with a needle end for releasable insertion of the needle end through the nozzle assembly and into the injection orifice thereof for blocking the injection orifice by operation of the linear actuator when combustion is not desired and retracting from and opening the injection orifice by operation of the linear actuator when combustion is desired.

26. The waste oil burning device as defined in claim 25, and further including a control system, the control system including electrical connections to a heat sensing means for sensing the temperature of the oil in the circulatory system, and the control means connected to the pumping means and the heater of the circulatory system and further connected to the diverting valve means of the combustion oil system for first providing for operation of the pumping means and heater to allow for heating of the oil and heating of the atomizing gun body and nozzle assembly by circulation of the heated oil in the circulating oil channel of the atomizing gun body portion to a predetermined optimal oil combustion temperature as detected by the heat sensing means so that the diverting valve means can not be operated to provide oil to the combustion oil conduit unless such predetermined temperature is first reached.

27. The waste oil burning device as defined in claim 26, and the control system further having operational control of the linear actuating means and of a pressurized air control valve means connected to the pressurized air conduit for providing a substantially simultaneous flow of combustion oil and atomizing air towards the oil injection orifice of the nozzle assembly for injection of atomized oil into the combustion chamber when combustion is desired and when the predetermined combustion temperature has been reached.

28. The waste oil burning device as defined in claim 27, and the linear actuator operated by pressurized air and connected to the pressurized air conduit and controlled by operation of the pressurized air control valve means.

29. The waste oil burning device as defined in claim 26, and the control system further including control means for turning off the oil heater of the circulating system when combustion is stopped and for continuing the operation of the pump and circulation of oil in the circulating system for a period of time after combustion has ceased for providing cooling of the atomizing gun and the nozzle assembly by the flow of oil through the circulatory channel of the atomizing gun.

30. The waste oil burning device as defined in claim 25, and the circulating system including relief valve means for maintaining the oil within the circulating system at a pressure above atmospheric suitable for resisting the production of gasses from the oil.

31. The waste oil burning device as defined in claim 25, and the combustion system including regulating valve means for maintaining the oil within the combustion oil channel at a pressure above atmospheric suitable for resisting the production of gasses from the oil.

32. The waste oil burning device as defined in claim 25, and the atomizing gun further including an elongate heat exchange gun body portion connected to the nozzle assembly, and the circulating channel extending through the body portion.

33. The waste oil burning device as defined in claim 32, and the combustion oil channel extending through the gun body portion.

34. The waste oil burning device as defined in claim 33, and the gun body portion including an atomization oil channel extending there through for providing fluid communication of pressurized atomizing air from the pressurized air conduit to the nozzle assembly.

35. The waste oil burning device as defined in claim 25, and the nozzle assembly including atomizing air channel means and combustion oil channel means for directing the flow of pressurized air and combustion oil there through respectively in a manner that prevents the mixing of the combustion oil and pressurized air until injection thereof out of the injection orifice into the combustion chamber, and the nozzle assembly including a needle guide channel means for guiding the needle end there through to the injection orifice.

36. The waste oil burning device as described in claim 35, and further including means for providing for releasable securing of the nozzle assembly to the gun body portion, the securing means including tube means for allowing coupling of the atomizing air channel of the body portion to the air channel means of the nozzle assembly and coupling of the combustion oil channel of the body portion to the oil channel means of the nozzle assembly in a manner that provides for the isolation of the combustion oil and the atomizing air and that permits the insertion and operation through the tube means of the needle end. channel means for directing the flow of pressurized air and combustion oil there through respectively in a manner that prevents the mixing of the combustion oil and pressurized air until injection thereof out of the injection orifice into the combustion chamber, and the nozzle assembly including a needle guide channel means for guiding the needle end there through to the injection orifice.

37. The waste oil burning device as defined in claim 25, and a filter located on the circulatory system at a position thereon downstream of the heater.

* * * * *